US005641217A

United States Patent [19]

Caruso et al.

[11] Patent Number: 5,641,217

[45] Date of Patent: Jun. 24, 1997

[54] SLIDE SHELF SYSTEM FOR A DELI/ CRISPER DRAWER

[75] Inventors: Jerome Caruso, Lake Forest, Ill.; Mark J. Blahnik, Sun Prairie; Philip F. Hottmann, Cross Plains, both of Wis.

[73] Assignee: Sub-Zero Freezer Company, Inc., Madison, Wis.

[21] Appl. No.: 510,144

[22] Filed: Aug. 2, 1995

[51] Int. Cl.[6] ..... A47B 88/04

[52] U.S. Cl. ..... 312/404; 312/408; 312/334.23

[58] Field of Search ..... 312/404, 408, 312/410, 246, 308, 298, 311, 334.23, 334.4, 132; 62/DIG. 11; 108/108, 159; 211/153

[56] References Cited

U.S. PATENT DOCUMENTS

| | | | |
|---|---|---|---|
| 2,689,778 | 9/1954 | Chambers et al. | 312/334.23 X |
| 3,063,772 | 11/1962 | Kennedy | 312/311 X |
| 3,633,983 | 1/1972 | Whitcomb | 312/306 |
| 4,173,378 | 11/1979 | Hanson et al. | 312/296 |
| 4,729,613 | 3/1988 | Tromble et al. | 211/153 X |
| 4,735,470 | 4/1988 | Falk | 312/408 X |
| 4,960,308 | 10/1990 | Donaghy | 312/404 |
| 5,226,707 | 7/1993 | Han et al. | 312/408 |
| 5,441,338 | 8/1995 | Kane et al. | 312/408 |

*Primary Examiner*—Peter M. Cuomo
*Assistant Examiner*—Janet M. Wilkens
*Attorney, Agent, or Firm*—Foley & Lardner

[57] ABSTRACT

A cantilevered storage shelf assembly for supporting a deli/crisper drawer assembly within a refrigerator having a glass panel, a pair of L-shaped steel brackets aligned on each side of the panel and a frame molded around the edges of the panel with the steel brackets encapsulated in the frame to form a unitary structure, the brackets being located in a parallel spaced relation for mating engagement with slots provided in the vertical strips in the back of the refrigerator, the drawer assembly comprising a pair of rails mounted on the frame, each rail having a tab at each end for matingly engaging the slots in the front and back of each side of the frame and a drawer slidably mounted on the rails.

2 Claims, 6 Drawing Sheets

SLIDE SHELF SYSTEM FOR A DELI/ CRISPER DRAWER

FIELD OF THE INVENTION

The present invention relates to a deli/crisper drawer for a refrigerator and more particularly to a slide system for sealing the drawer to a shelf in a refrigerator.

BACKGROUND OF THE INVENTION

Household refrigerators have evolved design considerations for the storage of various types of fresh foods. In this regard various types of deli/crisper drawers have been designed specifically for the storage of such comestibles. These drawers are generally permanently located in a specific position within the refrigerator. This limits the ability to rearrange the shelving or storage compartments to facilitate reorganization or to take advantage of other ranges of adjustability to clean around the structural component. Accordingly, it is apparent that the need yet exists to provide an improved crisper module with adjustable disposition within the cavity of a refrigerator which may be positioned at the desires of a user to facilitate interior organization which cooperates with the refrigerator structure under all manner and variety of loading conditions and which also facilitates the ability to clean the interior of the refrigerator or at least it does not hinder that objective.

SUMMARY OF THE PRESENT INVENTION

The present invention relates to a deli/crisper compartment which is adjustably supported on one of the cantilevered shelves in a refrigerator or freezer cabinet. The shelves are formed as single units having a glass panel and two steel brackets which are placed into an injection mold so as to encapsulate all of the parts, and thus form a single unified structure for supporting a deli/crisper drawer. The resulting structure thus results in a complete shelf form which is easily cleaned and spillproof because of the resultant seal between the plastic and glass.

The molded frame is provided with unique pockets on the underside of the glass panel which will accept the molded slides, which are easily pivoted and securely snapped into position by either the manufacturer or the consumer. A seal member is provided on the front and back of the shelf in a position to engage the front and back of a deli or crisper drawer when closed.

One of the unique features of the invention is the option to mount the crisper drawers below any of the shelves of the refrigerator.

Another of the features of the present invention is the attachment of slides under the surface of the shelf for supporting a crisper drawer. In this regard, each of the slides is provided with a riser at both ends of the slides for lifting the rim of the crisper seal into engagement with seals provided on the bottom of the shelf.

A further feature of the invention is the universal orientation of the parts in that the slides can be interchanged.

Other principal features and advantages of the invention will become apparent to those skilled in the art upon review of the following drawings, the detailed description and the appended claims.

Figure 1:
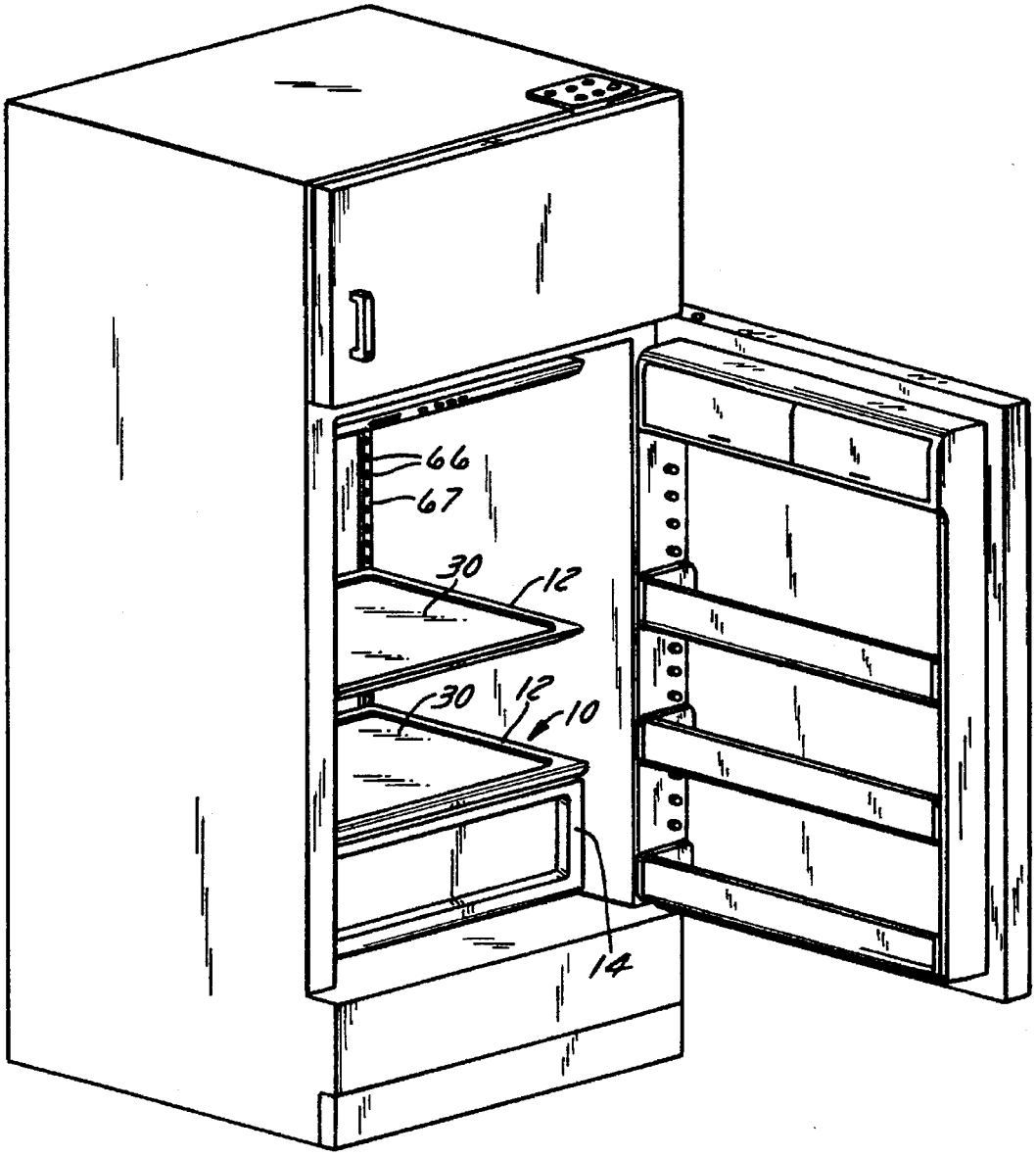
FIG. 1 is a perspective view of the refrigerator with the door open, showing a shelf having a drawer or crisper supported in a closed position in the refrigerator.
Figure 2:
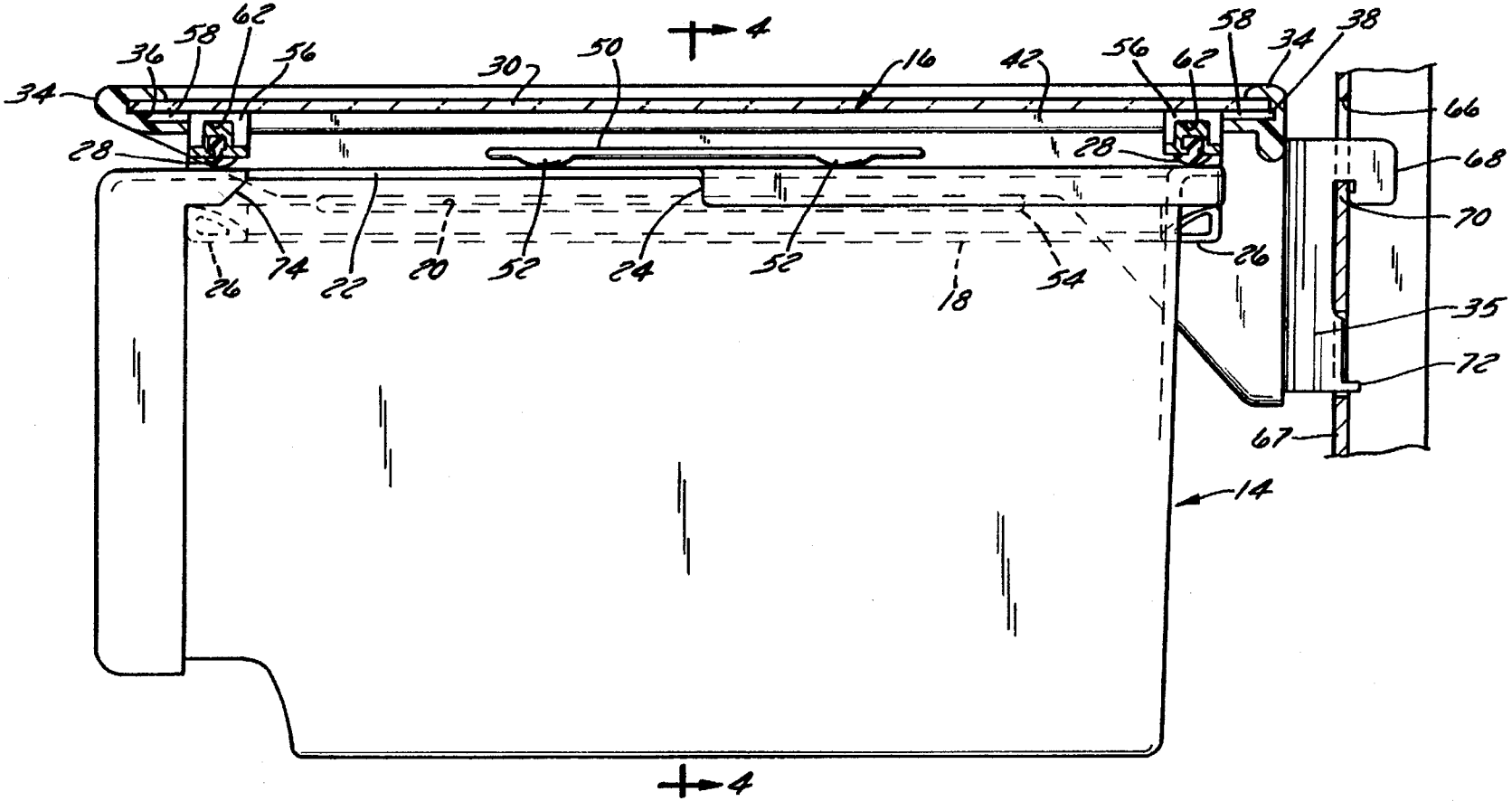
FIG. 2 is a side view in section of the shelf with the crisper positioned in a closed position with respect to the shelf
Figure 3:
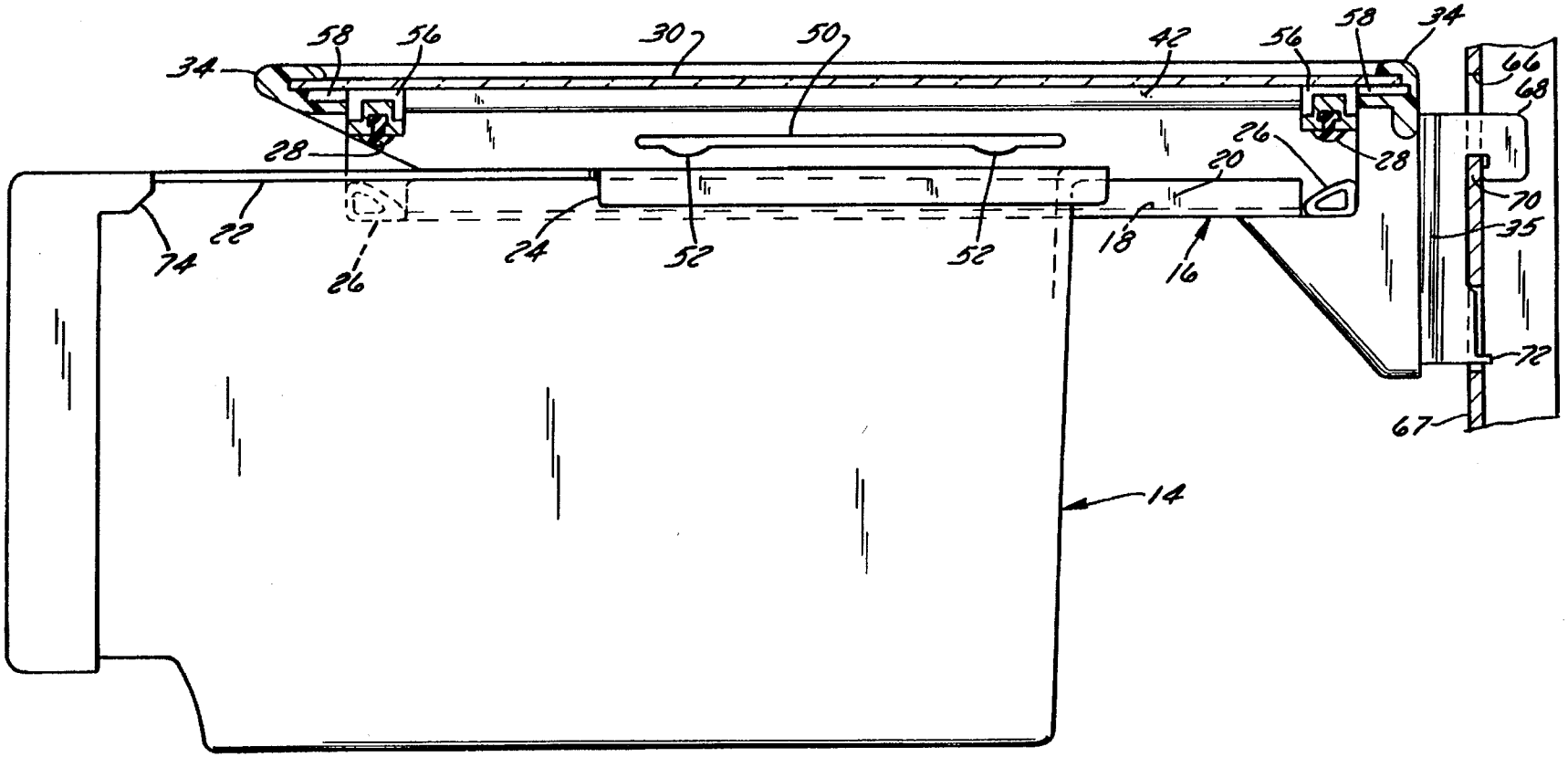
FIG. 3 is a side view similar to FIG. 2 showing the crisper in the open position.
Figure 4:
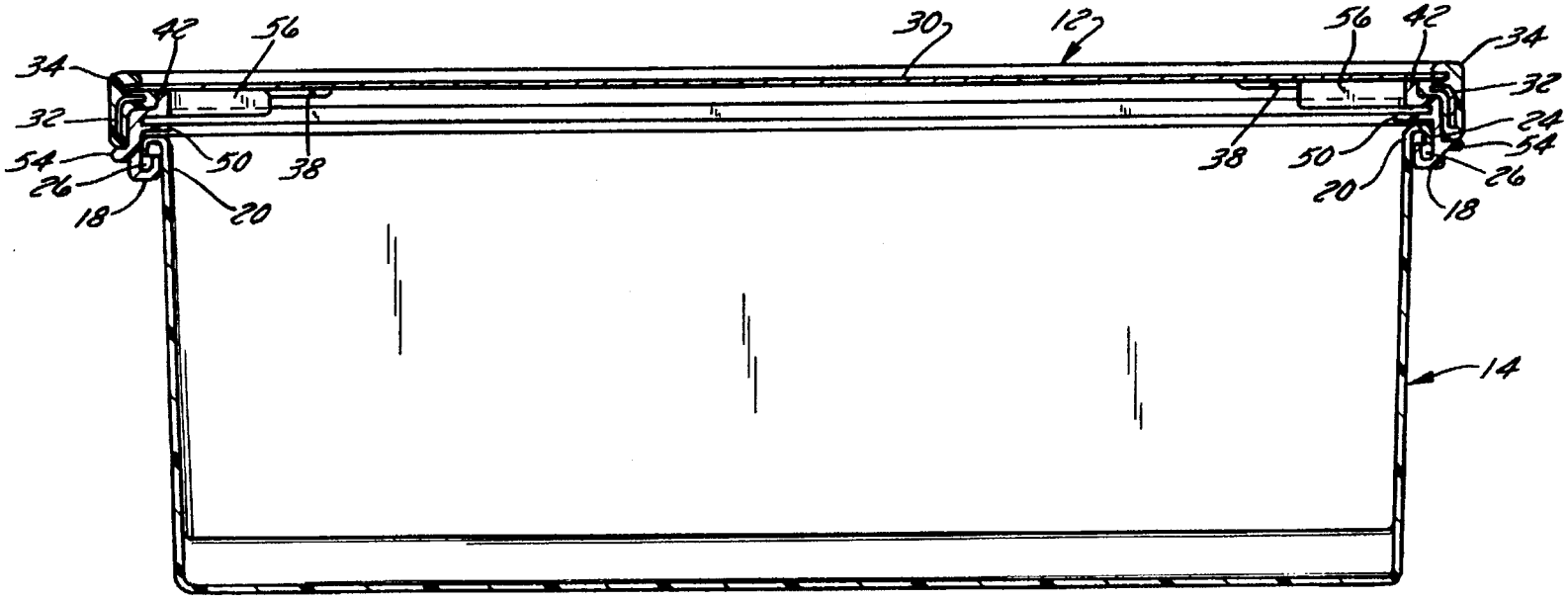
FIG. 4 is a cross sectional view taken on line 4—4 of FIG. 2.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 5:
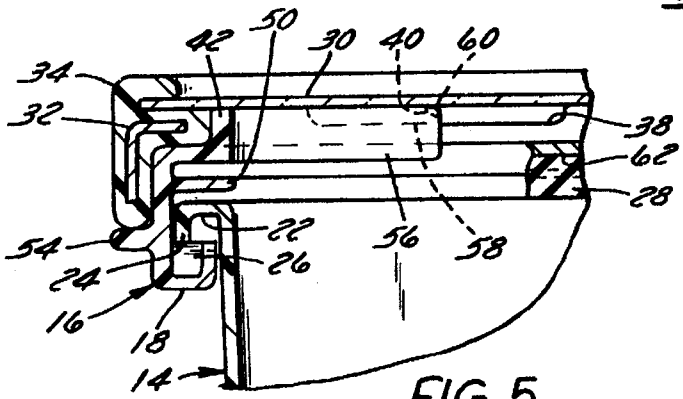
FIG. 5 is an enlarged view of the left corner of the crisper shelf shown in the closed position.
Figure 7:
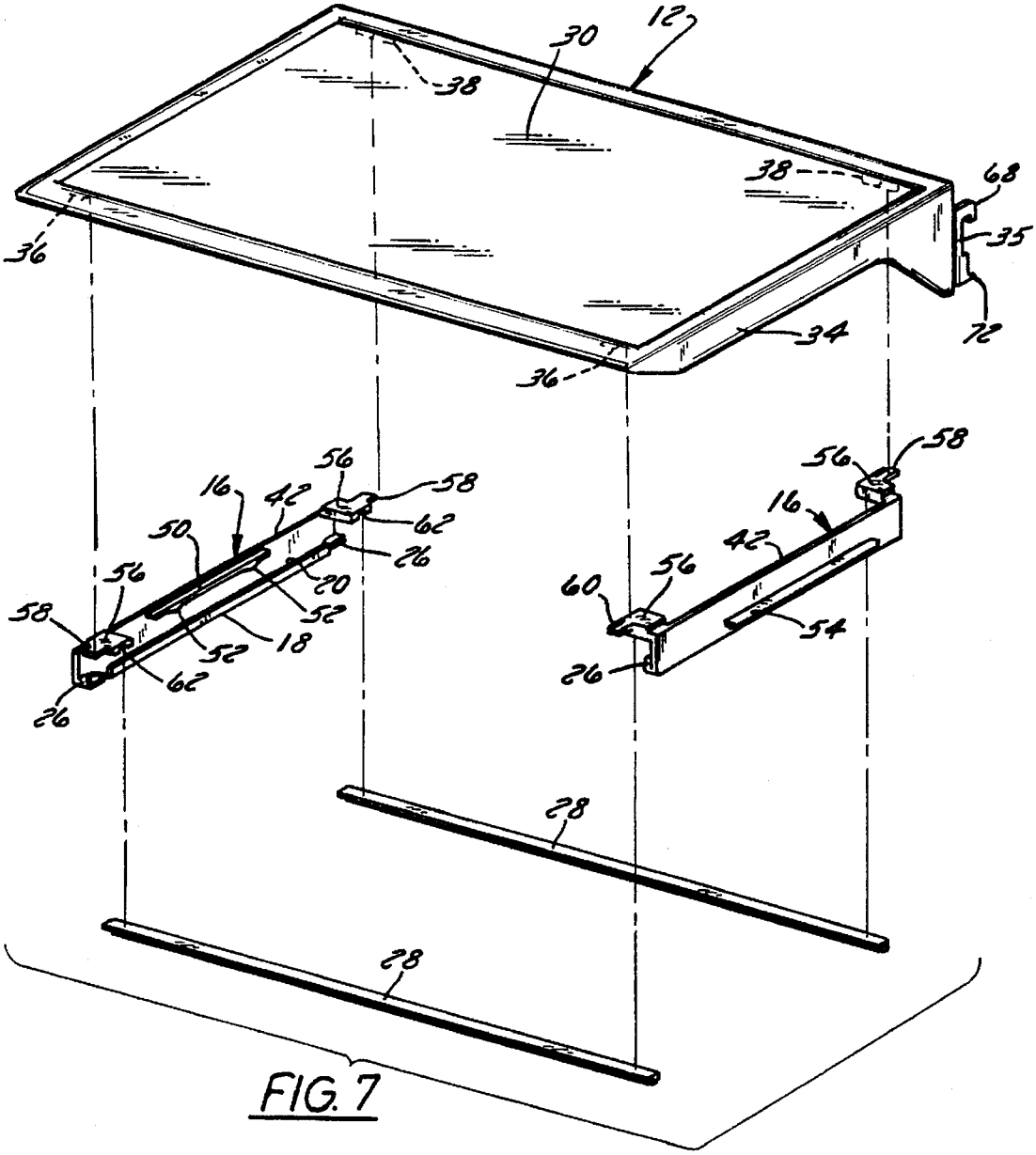
FIG. 7 is an exploded view of the shelf assembly.
Figure 8:
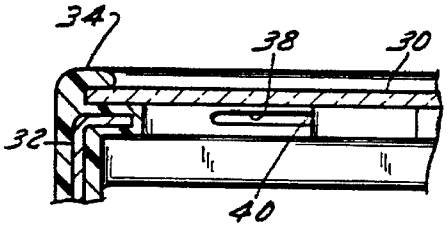
FIG. 8 is a partial section view of the left back corner of the tray.
Figure 9:
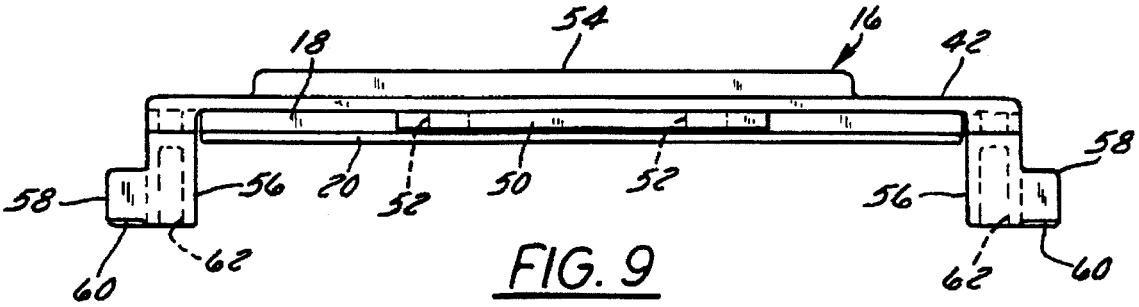
FIG. 9 is a top view of one of the rails.
Figure 10:
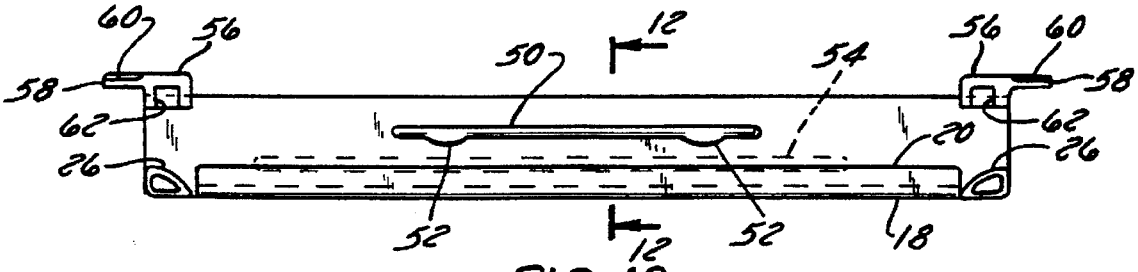
FIG. 10 is a side view of the rail shown in FIG. 9.
Figure 12:
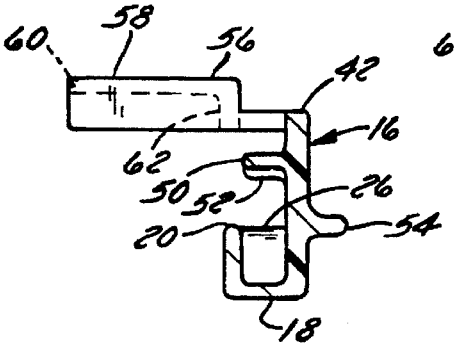
FIG. 12 is taken on line 12—12 on FIG. 10.
Figure 13:
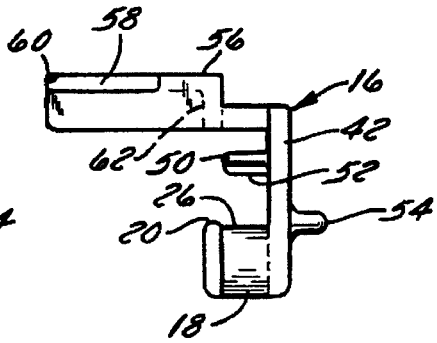
FIG. 13 is an view of one end of FIG. 10.
Figure 11:
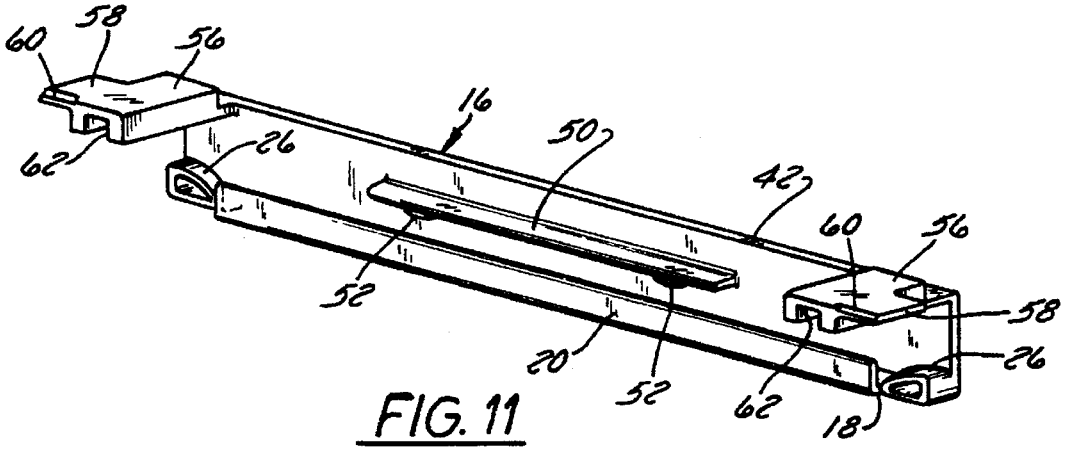
FIG. 11 is a perspective view of the rail.

The crisper assembly 10 as shown in FIG. 1 generally includes a shelf 12 and a crisper drawer 14 slidably mounted on a pair of rails 16 which are removably locked into the underside of the shelf 12. Each of the rails 16 includes a flange 18 on the bottom and a vertical wall 20 formed on the edge of the flange 18. The drawer 14 is provided with a flange 22 formed on the top of each side of the drawer 14 with a vertical wall 24 formed on the outer edge of each of the flanges 22. It should be noted that a labyrinth type seal is formed by the flange 18 and wall 20 when overlapped by flange 22 and wall 24 as shown in FIG. 5. Means in the form of a pair of risers 26 are formed on each end of the flange 18 and wall 20 on rails 16 to raise the front and back of the crisper into engagement with seals 28 provided on the bottom of the front and back of the shelf.

Figure 6:
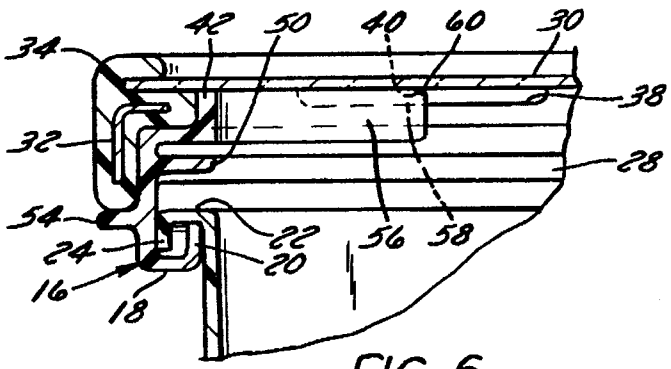
FIG. 6 is a view similar to FIG. 5 with the crisper shown in the open position.

More particularly and referring to FIGS. 4–7 the shelf 12 includes a glass panel 30 and a pair of L-shaped steel strips 32. A plastic frame 34 is molded around the edges of the glass panel with the steel strips 32 embedded in the molding 34 in a parallel spaced relation on each side of the glass panel. A bracket 35 is provided on the inner end of each of the strips 32 which protrude outwardly for mounting the shelves in the refrigerator as described hereinafter. A pair of slots 36 are provided in the molded edge of the frame under the front of the glass panel 30 and a pair of double width slots 38 are provided in the back edge of the frame under the glass panel 30. A rib 40, FIGS. 5 and 6, is centered in each of the slots 38 to lock the rails 16 in the slots as described hereinafter.

The rail 16 as shown in FIGS. 9 through 13 generally includes a vertical wall 42 having a horizontal flange 18 formed on the bottom of the wall and a vertical flange 20 formed on the outer edge of the flange 18. The risers 26 are formed on the wall 42 at each end of the flange 18. A flange 50 is molded on the inside of the wall 42 in a spaced relation to the top of the wall 42. An arcuate tab 52 is provided on the bottom of the flange 50 located in a spaced relation to each end of flange 50 to engage the flange 22 when the drawer is closed. A flange 54 is also formed on the outside of the wall 42. Means are provided at each end of the wall 42 for locking the rails 16 to the underside of the shelf 12.

In this regard a seal housing 56 is formed on each end of the upper edge of the wall 42. A flange 58 is formed on each housing 56 which extends outwardly from the housing 56. Each flange 58 includes a recess 60 on one side which matingly engages the rib 40 in the slot 38 when the flange 50 is seated in the slot 38. The housing 56 also includes a slot 62 for supporting the ends of the rubber seal 28 which sticks to the flat underside of the shelf. The flange 54 is provided on the outside of the wall 42 for engaging the edge of plastic molding 34 as shown in FIGS. 5 and 6.

The shelves 12 are supported in the refrigerator by means of the brackets 35 which matingly engage slots 66 in the steel uprights 67 in the back of the refrigerator. Each bracket includes a hook 68 having a slot 70 on the bottom and a centering guide 72 provided on the bottom of the bracket which is spaced to matingly engage the slot immediately below the slot in which the hook is aligned.

The rails 16 are mounted on the bottom of the shelf by inserting one of the flanges 58 angularly into the slot 36 at the front of the shelf. The flange 58 at the other end of the rail is angularly aligned with the double slot 38 in the back of the frame. The rail is pivoted in slot 36 and at the same time the flange 58 pivoted radially into one side of the double slot 38 until the recess 60 is aligned with the rib 40 and the flange 54 is seated against the molding 34.

The drawer 14 is mounted on the rails 16 by aligning the flange 24 on each side of the drawer with the risers 26 at the front of the shelf and sliding the drawer inward until the flange 24 drops off the riser 26 so that the ledge 22 slides on the wall 20 to the back of the shelf. The shelf is seated against the seals 28, by the simultaneous engagement of the inner end of the panel 24 with the riser 26 at the back of the shelf and the camming surface 74 at the front of the shelf with the riser 26 at the front of the rail. The flange 24 will matingly engage the inside of wall 42 to form a seal between flange 24 and the inside of the wall 42.

Thus, it should be apparent that there has been provided in accordance with the present invention a slide shelf system for a deli/crisper drawer that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A self-sealing drawer assembly comprising a refrigerator shelf, a pair of rail assemblies mounted in a parallel spaced relation on the bottom of the shelf, and a drawer supported on said rail assemblies for sliding movement between open and closed positions with respect to the shelf wherein each of said rail assemblies includes a riser on each end and said drawer includes a camming surface at each end positioned to simultaneously engage said risers whereby said drawer will be moved upward into sealing engagement with said shelf when the drawer is closed.

2. The shelf assembly according to claim 1 including a seal mounted on the front and back of the underside of the shelf for engaging the front and back of the drawer when the drawer is fully closed.

* * * * *